United States Patent [19]

Hulon

[11] Patent Number: 4,842,153

[45] Date of Patent: Jun. 27, 1989

[54] BIOLOGICAL PRODUCT SHIPPING TUBE

[76] Inventor: Walter C. Hulon, P.O. Box 40745, Baton Rouge, La. 70835

[21] Appl. No.: 176,857

[22] Filed: Apr. 4, 1988

[51] Int. Cl.[4] ..... B65D 59/00

[52] U.S. Cl. ..... 215/365; 53/449; 53/472; 206/523; 206/591; 215/1 C; 215/31; 215/230

[58] Field of Search ..... 215/31, 365, 1 C, 1 R, 215/230, 12.1; 53/449, 472; 206/523, 591, 594, 524.1, 525, 828

[56] References Cited

U.S. PATENT DOCUMENTS

| | | | |
|---|---|---|---|
| 978,736 | 12/1910 | Graham | 215/31 |
| 1,788,129 | 1/1931 | Stephenson | 215/31 X |
| 3,265,520 | 8/1966 | Obenshain | 215/1 R X |
| 4,007,848 | 2/1976 | Snyder | 215/31 |
| 4,111,322 | 9/1978 | Obrist et al. | 215/230 |
| 4,155,474 | 5/1979 | Bizzarri | 215/365 |
| 4,573,604 | 3/1986 | Guim | 215/1 C X |
| 4,595,110 | 6/1986 | Herr | 215/252 |
| 4,649,068 | 3/1987 | Collette | 215/31 X |
| 4,715,504 | 12/1987 | Chang et al. | 215/1 C |

OTHER PUBLICATIONS

Photocopies of a preform for a two liter soft drink container (date unknown).

*Primary Examiner*—Donald F. Norton
*Attorney, Agent, or Firm*—Harrison & Egbert

[57] ABSTRACT

A biological product shipping tube comprising a first tubular section having a closed end, a second tubular section integrally connected to the first tubular section, a collar formed at the end of the second tubular section opposite the first tubular section, and a cap-closure arrangement formed at the other side of the collar from the second tubular section. The first tubular section defines the bottom portion of the shipping tube. The second tubular portion has a non-tapered exterior. The interior of the first tubular section communicates and is aligned with the interior of the second tubular section. The collar has a greater outer diameter than the second tubular section. The second tubular section has identification information integrally imprinted onto the exterior surface. The collar has a flat chordal edge along its outer diameter. The identification information is printed adjacent to this flat chordal edge. The cap closure comprises a cap threadedly connected to a threaded portion of a cylindrical section extending from the collar. A compressible insert is contained and freely movable within the interior of the first tubular section.

20 Claims, 4 Drawing Sheets

FIG. 2
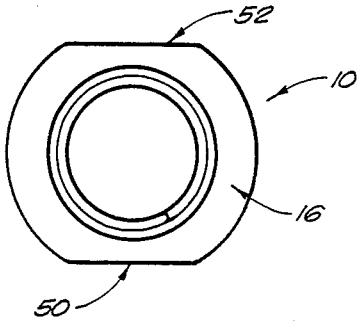
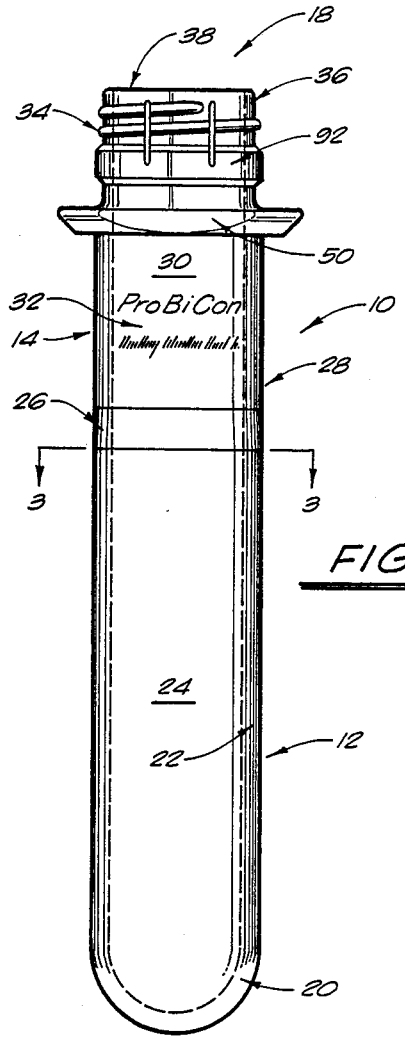
FIG. 1
FIG. 3
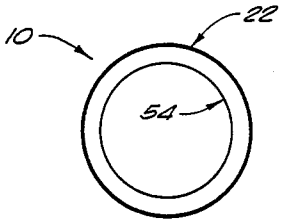

BIOLOGICAL PRODUCT SHIPPING TUBE

TECHNICAL FIELD

The present invention relates to packages and containers for the shipment of biological products. More particularly, the present invention prelates to methods and apparatus for the packaging and shipment of materials contained in a fragile container.

BACKGROUND ART

From the beginning of commerce, packaging has been indispensable in the movement of many kinds of products. Animal skins, baskets woven from reeds, and earthenware vessels may be considered the packages of prehistoric man. The ancient world contributed glass bottles, clay amphorae, and leather bags. The cask was probably an invention of the middle ages. But it was not until the Industrial Revolution, which created a need for packaging great numbers of similar items for shipping, that the packaging industry became economically important.

Virtually all modern manufactured and processed goods require a packaging at some stage of their production and distribution. Fresh foods need the protection and convenience that packaging gives. Specialized knowledge and skills, as well as specific machinery and facilities, are required to produce packages that meet one or more of five basic demands: protection from the environment; containment as a handlable unit; machine performance in the packaging process (such as on filling machines); communication to identify contents and to aid in marketing; and convenience to everyone concerned with the making, distribution, and use of the product; in addition, disposal of the package must be easy.

Of the large number of plastic materials available in the early 1970's, only a few have made a substantial impact on packaging: polyethylene (often referred to as polythene), polystyrene, polyvinyl chloride, and polypropylene. Others, such as thermosetting resins and saran have limited applications as closures and coatings. More than half the polythene is used in film form and much is converted into shrink film, liners, sacks, and bags. Some is used in the form of models, a little for larger specialized containers, and the remainder for coatings or laminates. Polystyrene is principally made into tubs for ice cream, packs for eggs, sausages, and small pots or jars for butter, jam, and cheese; or used in expanded form for packaging typewriters, record players, and other delicate machinery; or formed from expanded sheet into trays for fresh foods, cameras, or other lighter weight goods needing attractive protection against shock damage. Polyvinyl chloride is used typically for bottles for soft drinks, cooking oil and vinegar, and as trays for chocolates. The use of polypropelene is growing rapidly, especially as a transparent overwrap, in which it has strength advantages over cellulose film.

Molded thermoplastic containers are produced by blow molding, injection molding, or thermoforming. They generally have no special names, but are given the same description as the traditional containers that they emulate. The same type of container can often be made by more than one method. Thus, bottles are produced by either blowing or injection molding, and tubs can be produced by all three processes.

Polystyrene is the main plastic used for injection-molded containers, but polypropelene is beginning to be employed in this field. Such containers are light in weight and chemically inert, and those from polystyrene can be produced in glass-clear form, if required. Polystyrene frequently is toughened by the addition of a small percentage of synthetic rubber, allowing it to be vacuum-formed into deep containers.

Many chemical products have obnoxious or hazardous properties. Explosives, poisonous materials and liquids that are corrosive or produce dermatitic or skin irritant effects, inflammable goods, materials that react either with air or water, radioactive materials, and the materials that are likely to cause spontaneous combustion all require special selection of materials and arrangements for packaging. More recently, and most importantly, the spread of AIDS-contaminated blood has required special care in the transportation, packaging, and shipment of blood products to laboratories. Further, disease-laden biological products require similar care in transport and shipment.

Present methods of shipping these hazardous biological products leave much to be desired. Typically, the blood samples are placed into a test tube and the test tube is sealed. Following the sealing of the test tube, the biological products are placed into a styrofoam overwrap or into a cardboard container. Shipping is conducted in common fashion from the clinic to the laboratory for testing. In the past, it has been very common for the blood samples to be crushed, damaged, or otherwise contaminated because of bad handling during the postal process. Heretofore, there has been no secure way of assuring that such contaminated blood would not permeate the package. In addition, countless man-hours and dollars have been wasted because of the improper and ineffective packaging and shipping of these biological products.

In addition to AIDS-contaminated blood, testing labs will receive a variety of biological products for testing. These include analysis of regular blood samples, serums, spinal fluids, and urine specimens. These specimens can be both human and animal. The difficulties inherent in the packaging and shipping of these biological products has created many problems in the past.

It is an object of the present invention to provide a shipping tube for the safe transport of biological products.

It is another object of the present invention to provide a shipping tube that is easy to load and easy to unload.

It is still a further object of the present invention to provide a shipping tube that prevents the inadvertent misuse of the shipping tube.

It is still another object of the present invention to provide a shipping tube that allows identification information to be aligned in a visually perceivable location.

It is still a further object of the present invention to provide a shipping tube that prevents the accidental leakage or contamination of the biological product contained within the shipping tube.

These and other objects and advantages of the present invention will become apparent from a reading of the attached specification and appended claims.

SUMMARY OF THE INVENTION

The present invention is a biological product shipping tube that comprises a first tubular section having a closed end, a second tubular section integrally connected to the first tubular section, a collar formed at the end of the second tubular section opposite the first tubular section, and a closure/cap arrangement formed at the other end of the collar from the second tubular section. The first tubular section defines the bottom portion of the shipping tube. The second tubular section has a non-tapered exterior. The interior of the first tubular section communicates with the second tubular section. The collar has a greater outer diameter than the second tubular section. The closure/cap arrangement serves to seal the interior of the shipping tube.

The first tubular section has a greater outer diameter than the second tubular section. Both the first and second tubular sections have aligned and matching inner diameters. The second tubular section has identification information integrally imprinted on to the exterior surface.

The collar has a first flat chordal edge on one side of the collar. A second flat chordal edge is on the other side of the collar opposite the first flat chordal edge. The second tubular section has identification information integrally imprinted and adjacent the first and second tubular sections. The collar has an inner diameter matching and aligned with the inner diameter of the first and second tubular sections.

The closure/cap arrangement comprises a threaded portion formed in a generally cylindrical section of the shipping tube. The generally cylindrical section has an inner diameter matching and aligned with the inner diameter of the first and second tubular sections and the collar. The threaded portion is for the receipt of a cap. The threaded portion also has a plurality of linear vents that extend therethrough. These linear vents extend longitudinally across the cylindrical section. The cylindrical section is integrally connected to the collar on the side opposite the second tubular section. The cap is placed in liquid-tight sealing relation with the cylindrical section. The cap is a mechanical, tamper-evident closure. The cap also has identification data imprinted on the top of the cap. The cap has a detachable collar extending about the bottom of the cap. This detachable collar separates from the cap upon removal of the cap from the cylindrical section of the shipping tube.

The shipping tube of the present invention further comprises a compressible insert contained and freely movable within the interior of the shipping tube. This compressible insert is a solid cylinder of styrofoam material. This solid cylinder of styrofoam material has a diameter smaller than the inner diameter of the first and second tubular sections of the shipping tube. The tubular body of the shipping tube of the present invention is made of a generally unbreakable material. Also, the material used to make the tubular body is transparent. In particular, this tubular body is comprised of a condensation polymer.

The present invention also includes a method of packaging biological products for shipment comprising the steps of: (1) placing the biological product into a test tube; (2) sealing the test tube so as to prevent the leakage of the biological product from the test tube; (3) inserting a compressible insert into a shipping tube such that the compressible insert passes to the bottom of the shipping tube; (4) inserting the test tube into the shipping tube such that the bottom of the test tube abuts the compressible insert within the shipping tube; (5) placing a cap closure in close juxtaposition with the top of the test tube such that the test tube deforms the compressible insert; and (6) rotating the cap closure such that the threads of the cap closure engage corresponding threads at the end of the shipping tube. The cap closure is rotated until a liquid-tight seal is formed between the top of the cap and the end of the shipping tube.

BRIEF DESCRIPTION OF THE DRAWINGS

FIG. 1 is a view in side elevation of the shipping tube of the present invention.

FIG. 2 is a top view of the shipping tube of FIG. 1.

FIG. 3 is a view taken across line 3—3 of FIG. 1.

DETAILED DESCRIPTION OF THE INVENTION

Figure 4:
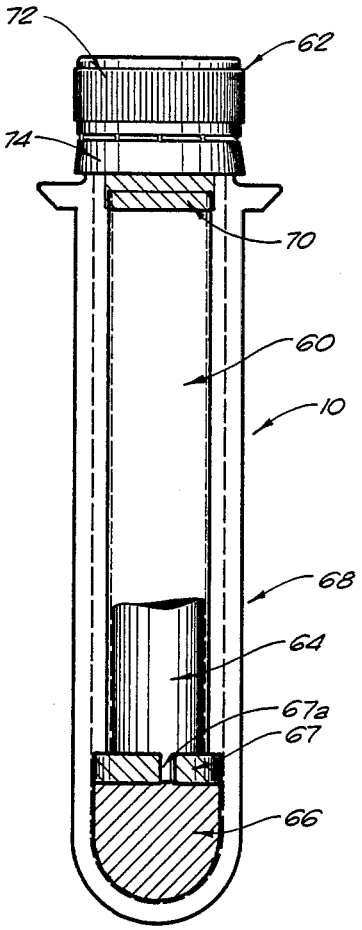
FIG. 4 is a side elevational view in partial cross-section of the shipping tube of the present invention and showing, in particular, the arrangement of the shipping tube as containing the test tube in proper condition for shipment.

Referring to FIG. 1, there is shown the shipping tube 10 of the present invention. Shipping tube 10 is especially designed for the shipment of biological products. Shipping tube 10 comprises a first tubular section 12, a second tubular section 14, a collar 16, and a cap closure arrangement 18. With notable exceptions, the shipping tube 10 has a configuration somewhat resembling that of a preform to a two-liter soft drink container.

The first tubular section 12 has a rounded closed end 20. The first tubular section 12 defines the bottom portion of the shipping tube. The dotted line 22 illustrates the wall thickness of the shipping tube. The quality of material and the thickness of the wall make the material used in the shipping tube 10 virtually unbreakable.

The interior 24 of the first tubular section 12 acts as the receiving area for the test tube/container of the biological products (to be described hereinafter).

The second tubular section 14 is integrally connected through tapered ring 26 to the first tubular section. The second tubular section 14 has a non-tapered exterior 28. The interior 30 of the second tubular section 14 communicates with the interior 24 of the first tubular section 12. The taper ring 26 is the thread split for the apparatus used in the molding of the shipping tube 12. As such, the first tubular section 12 will have a slightly greater outer diameter than the second tubular section. Importantly, the interior diameters of the first tubular section 12 and the second tubular section 14 are aligned, concentric, and of equal size. The inner diameter of shipping tube 10 should have a size sufficient for the easy receipt of standard test tubes.

The second tubular section 14 has identification information 32 integrally imprinted on to the exterior surface. The identification information is available for identifying the brand of the shipping tube 10, the indication that it contains hazardous biological material, and a warning not to reuse the shipping tube. Other information could also be imprinted, labeled, or otherwise placed in area 32.

Collar 16 is formed at the end of the second tubular section 14 opposite the first tubular section 12. This collar 16 has a greater outer diameter than that of the second tubular section. The collar 16 extends outwardly for ease of handling, for proper tilting of the shipping tube 10, and for maintaining the identification information in a upright position.

The cap closure arrangement 18 is integrally connected to the collar 16 on the side of the collar opposite the second tubular section 14. This cap closure 18 comprises a threaded portion 34 formed on to a generally cylindrical section 36. The interior of this cylindrical section has an inner diameter that matches and is aligned with the inner diameters of the first tubular section 12 and the second tubular section 14. The threaded portion 34 is for the receipt of a cap (to be described hereinafter). As can be seen, the shipping tube 10 opens at 38 for the receipt of a test tube containing the biological material.

It should be noted at this point that there are significant differences between the configuration of the shipping tube 10 and the two-liter soft drink preform. In the process of making the two-liter soft drink containers, the preform is heated and air is injected at high pressure so as to expand the walls of the preform outwardly. In order to properly manufacture the end product/two-liter bottle, the second tubular section 24 must be tapered from the first tubular section 12. This taper is required for the proper sizing of the end product/bottle and for the proper clamping within the forming machinery. The present invention, on the other hand, does not utilize such a tapered second tubular section. After experimentation, it was found that this second tubular section 14 could not be used in the machinery used to manufacture the soft drink bottles. Without the tapered section, the forming machinery would not accept the shipping tube. As such, the fundamental configuration of the present invention prohibits its re-entry into the system as a preform for a soft drink bottle. This is particularly important considering that hazardous biological products could be shipped in the present invention.

FIG. 2 is a top view of the shipping tube 10. FIG. 2 illustrates, in particular, the configuration of collar 16. Collar 16 has a generally circular outer configuration. This circular outer configuration is interrupted with a first flat chordal edge 50 on one side of the collar 16 and a second flat chordal edge 52 on the opposite side of the collar 16. These chordal edges 50 and 52 have been formed so as to prevent the rolling behavior of the shipping tube 10 during actual shipment. It has been a problem with test tubes, in the past, that the tubes would roll, collide and mix during shipment. The formed flat edges 50 and 52 prevent such rolling action. Additionally, it can be seen that the identification information 32 is integrally imprinted on the second tubular section in a location generally adjacent the first chordal edge 50. Identical information 32 is also imprinted on the other side adjacent the second chordal edge 52. In use, the identification information will always appear at the top of the shipping tube. This is particularly advantageous in mass handling procedures.

FIG. 3 is a cross-sectional view of the shipping tube from the top of the first tubular section 12. As can be seen, the shipping tube 12 has a round shape and an even wall 22. The interior wall 54 is also circular. The interior diameter, as stated before, should have a size greater than the size of the test tube to be shipped.

FIG. 4 shows the shipping tube 10 as sealed in proper condition for shipment. As can be seen, a test tube 60 is enclosed within the shipping tube 10. A cap 62 threadedly engages the threaded portion 34 of the upper cylindrical section 36 of the shipping tube 10. The test tube 60 is a standard laboratory test tube. A hazardous biological product 64 is contained within this test tube. Although this description describes the product 64 as "hazardous", this is not meant as a limitation on the present invention. The test tube 60 could easily contain other biological products or materials. For example, test tubes 60 (of the type shown in FIG. 4) are used for the shipping of non-contaminated blood, serum, spinal fluid, urine, and other biological products. If required, the present invention could and should be utilized for the shipment of these other types of products.

Figure 10:
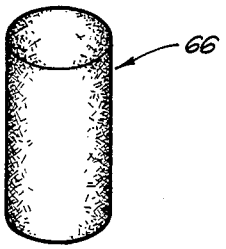
FIG. 10 is a perspective view of the compressible insert of the present invention.

The bottom of test tube 60 abuts and deforms a compressible insert 66. This compressible insert 66, illustrated in FIG. 10, is initially contained within the shipping tube 10 and is freely movable within the interior of the shipping tube 10. In shipment, this compressible insert deforms under the pressure of the bottom of test tube 64 so as to securely receive the bottom of this test tube 60. A sleeve 67 is juxtaposed against the top of the compressible insert 66. Sleeve 67 has an annular shape and an interior diameter suitable for receiving the exterior of test tube 60. A slit **67*a* extends through the sleeve 67 so as to allow the sleeve 67 to properly fit and receive the bottom of test tube 60. In operation, sleeve 67 further insulates the test tube 60 from encounters with the interior wall of shipping tube 10. Sleeve 67 also causes the test tube 60 to assume a more vertical alignment within shipping tube 10. The amount of deformation of the compressible insert 66 will be limited by the inner surface of the first tubular section 12 of the tubular body 68. The test tube 60 is sealed in a liquid-tight fashion by the use of a stopper 70. Stopper 70 can be made of rubber, plastic, or other material. Such stoppers are in common use in the shipment of test tubes containing biological material. The top of the test tube 60 and the plug 70 will abut the inside of the top of the cap 62. The compression exerted by the top 62 upon the plug 70, and the test tube 60, will cause the test tube 60 to remain firmly in position and will prevent any damage to the test tube 60** during shipment.

It can be seen in FIG. 4 that the cap 62 has a top portion 72 and a detachable collar 74. The cap used in the preferred embodiment of the present invention is a 28 millimeter beverage closure. This is a closure of a type manufactured by Ethyl Molded Products of Cincinnati, Ohio. The detachable collar is a mechanical, tamper-evident closure. The liquid-tight seal between the shipping tube 10 and the cap 62 is established and enhanced by the use of a cap liner. This liner and the cap are of the types to allow the cap to withstand up to two atmospheres of pressure.

Figure 5:
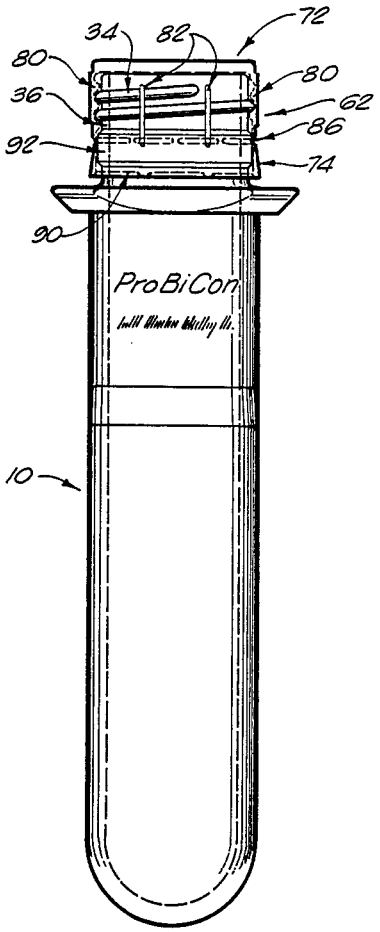
FIG. 5 is side elevational view in partial cross-section showing the fit of the cap in relation to the threaded portion of the shipping tube.

FIG. 5 shows, in cross-section, the manner in which the cap 62 engages the threaded portion 34 of the shipping tube 10. It can be seen that the cap 62 has relatively standard internal threads. These internal threads 80 will engage the ridges of the threads of the threaded portion 34. The threaded portion 34 includes a plurality of linear vents 82 extending therethrough. These linear vents 82 extend longitundinally across the cylindrical section 36 of the shipping tube 10. These vents 82 are a safety feature that allow any pressure buildup within shipping tube 10 to be vented downwardly during opening. In use, this will prevent the explosive removal of the top and, therefore, assure the safety of the person opening cap 62 from the shipping tube 10.

The detachable collar 74 is located at the bottom of the cap 62. A plurality of small plastic connectors 86 connect the detachable section 74 with the main cap body 72. When the cap 62 is secured to the shipping tube 10, a plurality of inwardly extending flaps 90 will engage the ridge 92 of the cylindrical portion 36 of the shipping tube 10. Upon removal, the resistance of these inwardly extending flaps 90 upon this ridge 92 will cause the main body portion 72 of cap 62 to detach from the detachable collar portion 74.

Figure 6:
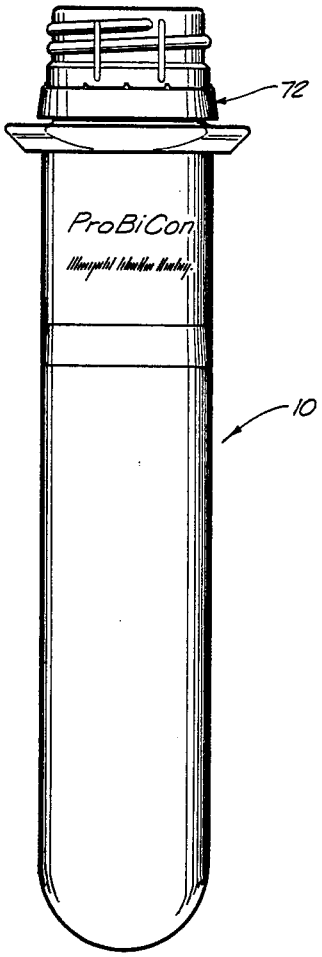
FIG. 6 is a side elevational view showing the configuration of the shipping tube of the present invention after opening and removal of the test tube.

FIG. 6 illustrates the appearance of the shipping tube 10 after shipment, opening, and removal of contents. As can be seen, the detachable collar 72 remains. In actual use, this is very important since the shipping tube 10 should only be used one time. Unless extraordinary efforts are exerted to remove the detachable collar 72, the detachable collar 72 will remain as an indicator to future users that the container 10 has been previously used.

It is important to consider the material used in the manufacture of the shipping tube 10 of the present invention. In the preferred embodiment of the present invention, the material of the shipping tube 10 will be either KODAPAK TM PET Copolyester 9921, or KODAPAK TM PET 7352. These are condensation polymers produced from dimethyl terephthalate (DMT) and ethylene glycol (EG) using continuous melt phase polymerization process followed by a solid state polymerization process. The KODAPAK TM copolyester 9921 is a clear material. The KODAPAK TM PET 7352 has a slight tint to it, but is otherwise transparent. These are extremely strong plastics that should not ever break during even extraordinary conditions of shipment and usage.

Figure 7:
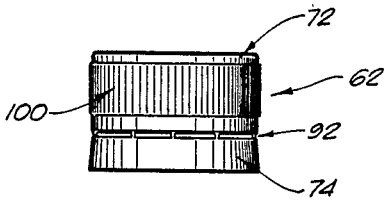
FIG. 7 is a side view of the closure cap of the present invention.

FIG. 7 illustrates the size of cap 62. As can be seen, cap 62 has the main threaded portion 72 and detachable section 74. The main threaded portion 72 has a plurality of ridges 100 formed thereon. These ridges 100 assist the user in the easy opening and closing of the cap 62 upon the threads 34 of the shipping 10. The small plastic connectors 92 can be seen in the illustration of FIG. 7.

Figure 8:
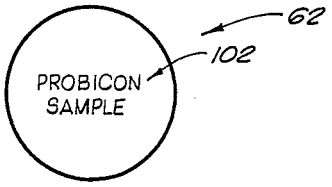
FIG. 8 is a top view of the closure cap of the present invention.

FIG. 8 shows the top of the cap 62. As can be seen, the top of the cap 62 is suitable for the impression of identification data 102. Alternatively, a number can be imprinted on the top of cap 62 that could coincide with a number on the detachable strip 74. Such number cross-referencing could be useful in the laboratory utilization of the shipping tubes of the present invention.

Figure 9:
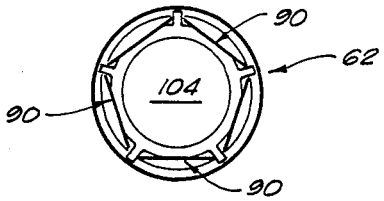
FIG. 9 is a bottom view of the closure cap of the present invention.

FIG. 9 shows the interior of the cap 62. As can be seen, a plurality of inwardly extending flaps 90 are formed inwardly of the periphery and bottom of cap 62. As stated previously, these inwardly extending flaps 90 will engage a portion of the top of the shipping tube 10. The liner 104 is a polypropelene liner. This special type of liner is suitable for protecting against leakage under pressure.

FIG. 10 illustrates the compressible insert 66. As can be seen, the compressible insert 66 is a solid cylinder of styrofoam material. This insert 66 has a diameter that is smaller than the inner diameter of the shipping tube 10. It should be noted that a plurality of the compressible inserts 66 may be used to provide the proper interior sizing for various sizes of biological product-containing test tubes.

Figure 11:
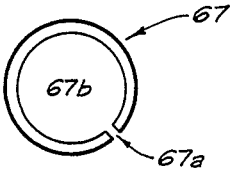
FIG. 11 is a top view showing the sleeve of the present invention.

FIG. 11 is a top view showing the configuration of the sleeve 67. As can be seen, sleeve 67 is an annular member having an inner area 67*b* that can receive the exterior of a there-inserted test tube. The slit 67*a* allows sleeve 67 to expand so as to receive various sizes of test tubes. The wall thickness of the sleeve 67 should be sufficient so as to prevent the length of the test tube inserted therein to encounter the wall of the shipping tube.

The present invention also provides a unique method for the packaging of biological products. In normal use, with reference to FIG. 4, the method of the present invention comprises the following steps. First, the biological product 64, hazardous or not, is placed into a test tube 60. Secondly, the test tube 60 is sealed with a topper or plug 70 so as to prevent the leakage of the biological product 64 from the test tube. Thirdly, a compressible insert 66 is inserted into the shipping tube 10 such that the compressible insert passes to the bottom of the shipping tube. Fourthly, the test tube 60 is inserted into the shipping tube such that the bottom of the test tube abuts the compressible insert 66 within the shipping tube 10. Fifthly, the cap 62 is placed in close juxtaposition with the top of the test tube 60 such that the bottom of the test tube 60 deforms the compressible insert 66. Finally, the cap 62 is rotated about the threads so as to cause the test tube 60 to further compress the deformable material 66. Cap 62 is rotated until a liquid-tight seal is formed between the top of the cap 62 and the end of the shipping tube 10. In this arrangement, the test tube 60 can be transported with virtual assurance against breakage.

For added protection of the test tube 60 during transport within the shipping tube 10, the method of the present invention can further include the step of inserting a styrofoam sleeve 67 into said shipping tube 10 prior to the step of placing the test tube 60 into the shipping tube. This styrofoam sleeve 67 will be received by the test tube and will move within the test tube so as to be juxtaposed against the top of compressible insert 66. When the test tube 60 is inserted, the interior 67*b* of the sleeve 67 will receive the exterior of the test tube 60. This will cause a "wedging" action that will keep the test tube vertically upright within the shipping tube and will prevent the glass of the test tube 60 from encountering the inner walls of the shipping tube 10.

The most important advantage of the present invention is, of course, that the test tube 60 can be shipped without breakage. The test tube 60 is maintained securely and firmly within the shipping tube 10. Importantly, if any breakage of the test tube 60 should occur, the biological product 64 will seep from the break in the test tube 60, but remain within the shipping tube 10. As a result, the biological product 64 will not be lost during shipment, even if the test tube 60 should break. The biological product 64 will not be contaminated since it is being contained within the sterile environment of the interior of shipping tube 10. As opposed to current methods of shipment, no biological product will seep from the shipping package containing the shipping tubes 10.

As stated previously, the shipping tube 10 cannot be reused in the process for the manufacture of soft drink containers. The information imprinted on the shipping tube will always remain upright, facing the handler of the tube, because of the configuration of the collar of the shipping tube. Once the shipping tube 10 is sealed, the detachable cap portion will provide visual evidence of any tampering during the process. Additionally, the shipping tube of the present invention is relatively easy to utilize by unskilled workers. The present invention eliminates the time consuming and difficult task of arranging styrofoam sheets to accommodate test tubes of biological material.

The foregoing disclosure and description of the invention is illustrative and explanatory thereof, and various changes in the method steps, as well as in the details of the illustrated apparatus, can be made within the scope of the appended claims without departing from the spirit of the invention. The present invention should only be limited by the following claims and their legal equivalents.

I claim:

1. A biological product shipping tube comprising:

a first tubular section having a closed end, said first tubular section defining the bottom portion of said shipping tube;

a second tubular section integrally connected to said first tubular section, said second tubular section having a non-tapered exterior, the interior of said first tubular section communicating with said second tubular section;

a collar formed at the end of said second tubular section opposite said first tubular section, said collar having a greater outer diameter than said second tubular section, said collar having a first flat chordal edge on one side of said collar and a second flat chordal edge on the side of said collar opposite said first flat chordal edge; and closure means formed at the other side of said collar from said second tubular section, said closure means for sealing the interior of said shipping tube.

2. The shipping tube of Claim 1, said first tubular section having a greater outer diameter than said second tubular section.

3. The shipping tube of claim 1, said second tubular section having identification information integrally imprinted onto the exterior surface of said second tubular section.

4. The shipping tube of claim 1, said second tubular section having identification information integrally imprinted adjacent said first flat chordal edge and identification information integrally imprinted adjacent said second flat chordal edge.

5. The shipping tube of claim 1, said closure means comprising a threaded portion formed onto a generally cylindrical section, said generally cylindrical section having an inner diameter matching and aligned with the inner diameters of said first and second tubular sections, said threaded portion for the receipt of a cap.

6. The shipping tube of claim 5, said threaded portion having a plurality of linear vents extending therethrough, said linear vents extending longitudinally across cylindrical section.

7. The shipping tube of claim 1, said closure means comprising a cap threadedly connected to a threaded portion of a generally cylindrical section, said generally cylindrical section integrally connected to said collar on the side opposite said second tubular section.

8. The shipping tube of claim 7, said cap being in a liquid-tight seal with said generally cylindrical section, said cap being a mechanical tamper-evident closure.

9. The shipping tube of claim 8, said cap having identification data printed on the top of said cap, said cap having a detachable collar extending about the bottom of said cap, said detachable collar separating from said cap upon the removal of said cap from said cylindrical section.

10. A biological product shipping tube comprising:

a first tubular section having a closed end, said first tubular section defining the bottom portion of said shipping tube;

a second tubular section integrally connected to said first tubular section, said second tubular section having a non-tapered exterior, the interior of said first tubular section communicating with said second tubular section;

a collar formed at the end of said second tubular section opposite said first tubular section, said collar having a greater outer diameter than said second tubular section;

closure means formed at the other side of said collar from said second tubular section, said closure means for sealing the interior of said shipping tube; and a compressible insert contained and freely movable within the interior of said first tubular section.

11. The shipping tube of claim 10, said compressible insert being a solid insert of styrofoam material, said compressible insert having a diameter smaller than the inner diameter of said first and second tubular sections.

12. The shipping tube of claim 10, further comprising:

a sleeve member positioned adjacent the top of said compressible insert, said sleeve member having a slit extending through the wall of said sleeve member.

13. A biological product shipping tube comprising:

a tubular body having a closed end, said tubular body having a generally even interior diameter;

a collar integrally formed at the end of said tubular body opposite said closed end, said collar having a flat chordal edge along a portion of the outer diameter of said collar; and closure means formed at the other side of said collar from said tubular body, said closure means for sealing the interior of said shipping tube.

14. The shipping tube of claim 13, said tubular body having identification information integrally impressed on the exterior of said tubular body adjacent said flat chordal edge of said collar.

15. The shipping tube of claim 13, said tubular body being generally unbreakable and comprised of a transparent material.

16. The shipping tube of claim 15, said tubular body and said collar comprised of a condensation polymer.

17. A method of packaging biological products for shipment comprising the steps of:

placing the biological product into a test tube;

sealing said test tube so as to prevent the leakage of the biological product from said test tube;

inserting a compressible insert into a shipping tube such that said compressible insert passes to the bottom of said shipping tube, said shipping tube being of a generally unbreakable material;

inserting said test tube into said shipping tube such that the bottom of said test tube abuts said compressible material in said shipping tube;

placing a cap closure in close juxtaposition with the top of said test tube such that said test tube deforms said compressible material; and rotating said cap closure such that the threads of said cap closure engage corresponding threads at the end of said shipping tube.

18. The method of claim 16, said cap closure being rotated until a liquid-tight seal forms between the top of said cap and the end of said shipping tube.

19. The method of claim 17, further comprising the step of:

inserting a test tube receiving sleeve into said shipping tube such that said test tube receiving sleeve abuts the top of said compressible insert.

20. The method of claim 19, said step of inserting said test tube further comprising:

depositing said test tube through the interior of said receiving sleeve.

* * * * *